US012669043B1

(12) United States Patent
Fowler

(10) Patent No.: US 12,669,043 B1
(45) Date of Patent: Jun. 30, 2026

(54) TOP DRIVE METHOD AND SYSTEM FOR OIL PRODUCTION

(71) Applicant: Elton D. Fowler, Victoria, TX (US)

(72) Inventor: Elton D. Fowler, Victoria, TX (US)

( * ) Notice: Subject to any disclaimer, the term of this patent is extended or adjusted under 35 U.S.C. 154(b) by 0 days.

(21) Appl. No.: 19/048,700

(22) Filed: Feb. 7, 2025

(51) Int. Cl.
*E21B 43/16* (2006.01)

(52) U.S. Cl.
CPC ..... *E21B 43/168* (2013.01)

(58) Field of Classification Search
CPC ..... E21B 43/16
See application file for complete search history.

(56) References Cited

U.S. PATENT DOCUMENTS 2,754,911 A * 7/1956 Spearow ..... E21B 43/18 166/268
3,788,398 A * 1/1974 Shephard ..... E21B 43/162 166/269
5,062,483 A * 11/1991 Kisman ..... E21B 43/168 166/305.1
5,267,615 A * 12/1993 Christiansen ..... E21B 43/18 166/272.2
5,503,226 A * 4/1996 Wadleigh ..... E21B 43/164 166/50
10,465,106 B2 11/2019 Thyne
11,162,342 B2 11/2021 Drescher et al.
2003/0141073 A1 7/2003 Kelley
2013/0312967 A1 11/2013 De Ghetto et al.

OTHER PUBLICATIONS

Okon, Anietie Ndarake, et al., "A Critical Evaluation of Water Coning Correlations in Vertical Wells," American Journal of Science, Engineering and Technology, 2018; 3(1): 1-9.

* cited by examiner

*Primary Examiner* — William D Hutton, Jr.
*Assistant Examiner* — Avi T Skaist
(74) *Attorney, Agent, or Firm* — Lewis & Reese, PLLC

(57) ABSTRACT

Described herein are methods and systems for enhanced oil recovery (EOR). The methods and systems are especially suitable for enhancing oil recovery in bottom-water drive producing formations having a gas cap where coning of bottom water is a problem. An external gas such as natural gas is injected into the gas cap. This essentially eliminates the bottom water drive and replaces it with top gas drive. The amount of gas delivered is calculated to replace the volume of oil produced from the well and maintain a constant pressure at the gas-oil interface, which maintains horizontal thrust to the production point and maintains a stable oil-water interface, preventing coning. The methods expand the area of oil recovery.

16 Claims, 6 Drawing Sheets

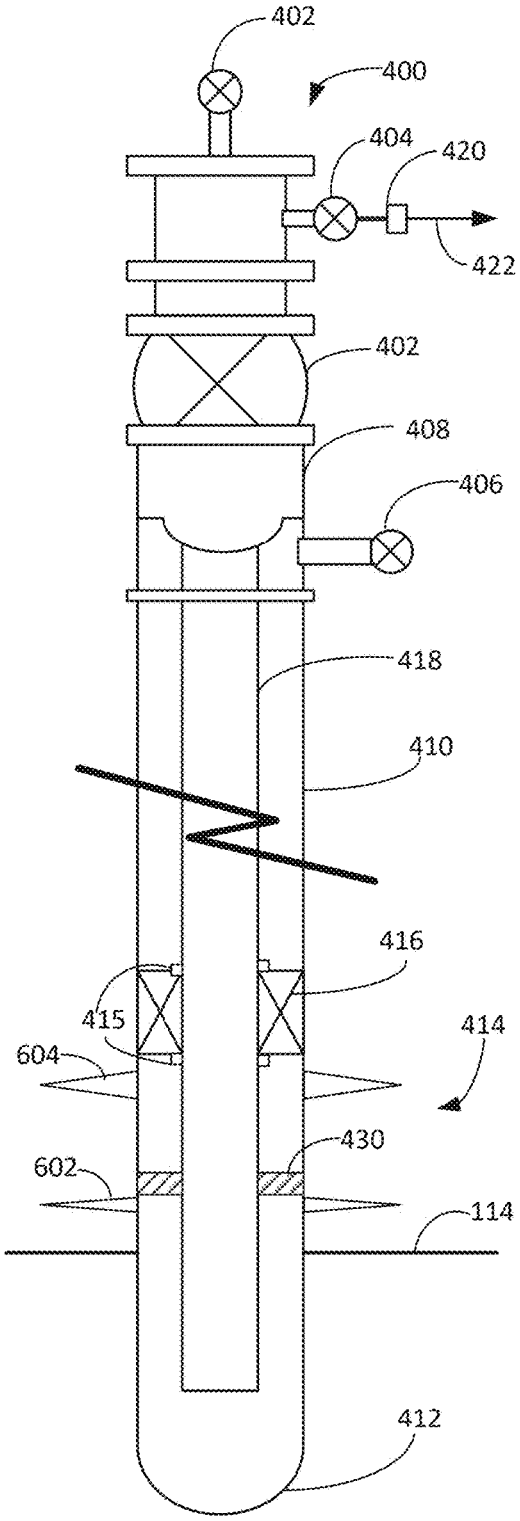
Figure 4A
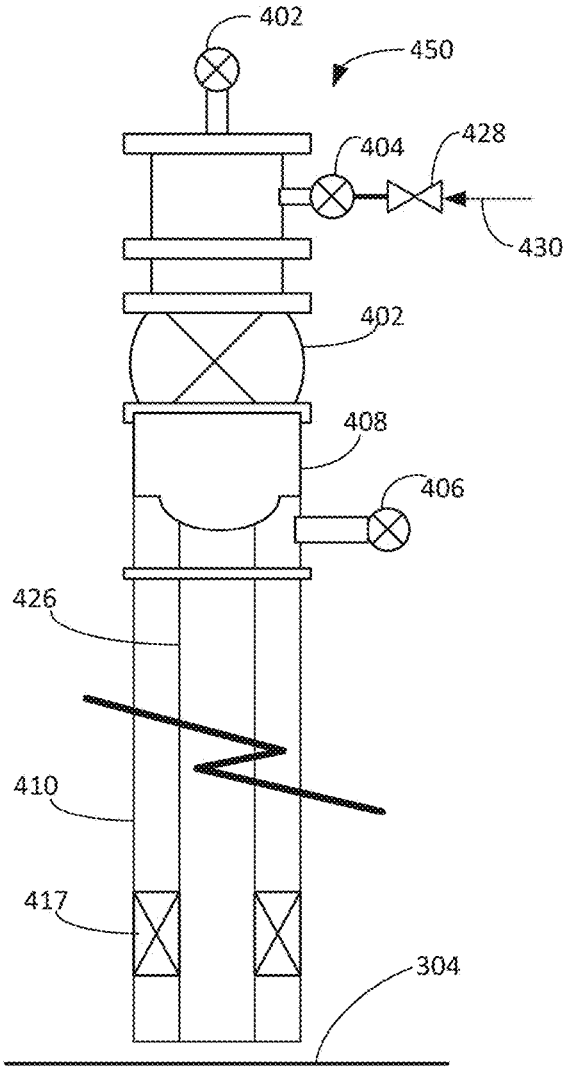
Figure 4B
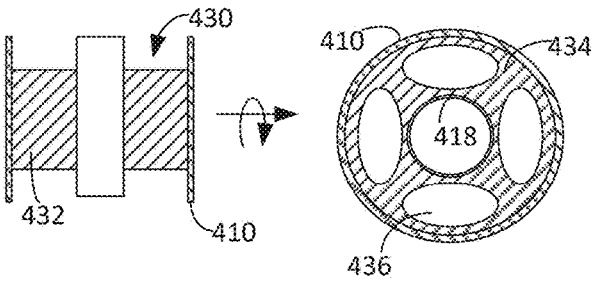

TOP DRIVE METHOD AND SYSTEM FOR OIL PRODUCTION

FIELD OF THE INVENTION

This application relates to enhanced production of oil from a reservoir, and more specifically to a top drive method to enhance oil recovery.

INTRODUCTION

It is reported that millions of oil wells have been drilled since 1859. Three natural drive mechanisms exist for providing a driving force to move oil to the surface through an oil well. Those mechanisms are solution gas drive, gas cap drive, and water drive. The bottom water drive mechanism is reported as being the most effective mechanism for recovery of the original oil in place (OOIP), with recovery reported from about 35% to about 75% of the estimated OOIP.

Bottom water drive oil wells are known to suffer from a phenomenon called "coning." Coning in bottom water drive oil wells occurs when water from the water drive is drawn into the oil production stream. Coning is recognized in the art as a production problem in which cap gas or bottom water infiltrates the perforation zone near the well bore area and reduces oil production. See, e.g., "A Critical Evaluation of Water Coning Correlations in Vertical Wells," Am. J. Sci., Eng. and Tech., 3:1, 2018, for a review of 38 studies of coning; see also "The Performance of Bottom Water-Drive Reservoirs," Trans. Am. Inst. Of Mining and Metallurgical Eng., 170:1, 81-111, 1947.

There is a need in the art for techniques for addressing coning in bottom water drive wells, as well as addressing other limitations of bottom water drive wells, thereby improving recovery of the estimated OOIP and increasing the area of recovery.

SUMMARY

Disclosed herein is a method of recovering oil from a producing formation in the earth, wherein the producing formation is abutted on top by a gas cap and on bottom by an aquifer, the method comprising: providing a production well extending through the producing formation, providing a gas injection well extending into the gas cap, injecting an external gas into the gas cap via the gas injection well, and producing the oil via the production well. According to some embodiments, the external gas comprises natural gas. According to some embodiments, the gas injection well is located about 40 to about 150 feet from the production well. According to some embodiments the gas injection well may be located within 60 feet of the production well. According to some embodiments, the gas injection well terminates above an interface between the gas cap and the producing formation. According to some embodiments, the production well comprises: a casing, a production tubing configured within the casing, a packer configured within an annulus between the casing and the production tubing, and perforations in the casing providing fluid communication between the producing formation and the annulus. According to some embodiments, the perforations are configured within a bottom third of the producing formation. According to some embodiments, the perforations comprise upper perforations and lower perforations configured below the upper perforations. According to some embodiments, the packer is affixed to the production tubing and wherein the production tubing is configurable in a first position wherein the packer does not block the upper perforations and in a second position wherein the packer blocks the upper perforations. According to some embodiments, producing oil comprises: producing oil for a first duration with the tubing in the first position, switching the tubing from the first position to the second position, and producing oil for a second duration with the tubing in the second position. According to some embodiments, the lower perforations are located about 12 to about 18 inches above an oil-water interface between the producing formation and the aquifer. According to some embodiments, injecting the external gas comprises injecting an amount of external gas to replace the produced oil. According to some embodiments, injecting the external gas comprises injecting an amount of external gas to maintain a pressure within the gas cap to within a predetermined threshold of an initial pressure. According to some embodiments, the initial pressure is a pressure measured when the gas injection well is completed. According to some embodiments, injecting the external gas comprises injecting an amount of external gas adequate to provide lift of oil within the producing formation. According to some embodiments, injecting the external gas into the gas cap maintains horizontal thrust of oil in the producing formation to the production well. According to some embodiments, producing the oil comprises producing the oil at a rate that substantially eliminates bottom water coning.

Also disclosed herein is a system for recovering oil from a producing formation in the earth, wherein the producing formation is abutted on top by a gas cap and on bottom by an aquifer. The system may comprise a production well extending through the producing formation, a gas injection well extending into the gas cap, and facilities for injecting an external gas into the gas cap via the gas injection well. According to some embodiments, the external gas comprises natural gas. According to some embodiments, the gas injection well is located about 40 to about 150 feet from the production well. According to some embodiments, the gas injection well terminates above an interface between the gas cap and the producing formation. According to some embodiments, the production well comprises: a casing, a production tubing configured within the casing, a packer configured within an annulus between the casing and the production tubing, and perforations in the casing providing fluid communication between the producing formation and the annulus. According to some embodiments, the perforations are configured within a bottom third of the producing formation. According to some embodiments, the perforations comprise upper perforations and lower perforations configured below the upper perforations. According to some embodiments, the packer is affixed to the production tubing and wherein the production tubing is configurable in a first position wherein the packer does not block the upper perforations and in a second position wherein the packer blocks the upper perforations. According to some embodiments, producing oil comprises: producing oil for a first duration with the tubing in the first position, switching the tubing from the first position to the second position, and producing oil for a second duration with the tubing in the second position. According to some embodiments, the lower perforations are located about 12 to about 18 inches above an oil-water interface between the producing formation and the aquifer. According to some embodiments, injecting the external gas comprises injecting an amount of external gas to replace the produced oil. According to some embodiments, injecting the external gas comprises injecting an amount of external gas to maintain a pressure within the gas cap to within a predetermined threshold of an initial pressure. According to some embodiments, the initial pressure is a pressure measured when the gas injection well is completed. According to some embodiments, injecting the external gas comprises injecting an amount of external gas adequate to provide lift of oil within the producing formation. According to some embodiments, injecting the external gas into the gas cap maintains horizontal thrust of oil in the producing formation to the production well. According to some embodiments, producing the oil comprises producing the oil at a rate that substantially eliminates bottom water coning.

BRIEF DESCRIPTION OF THE DRAWINGS

FIGS. 4A and 4B illustrate components of a production well and an injection well, respectively.

DETAILED DESCRIPTION

Figure 1:
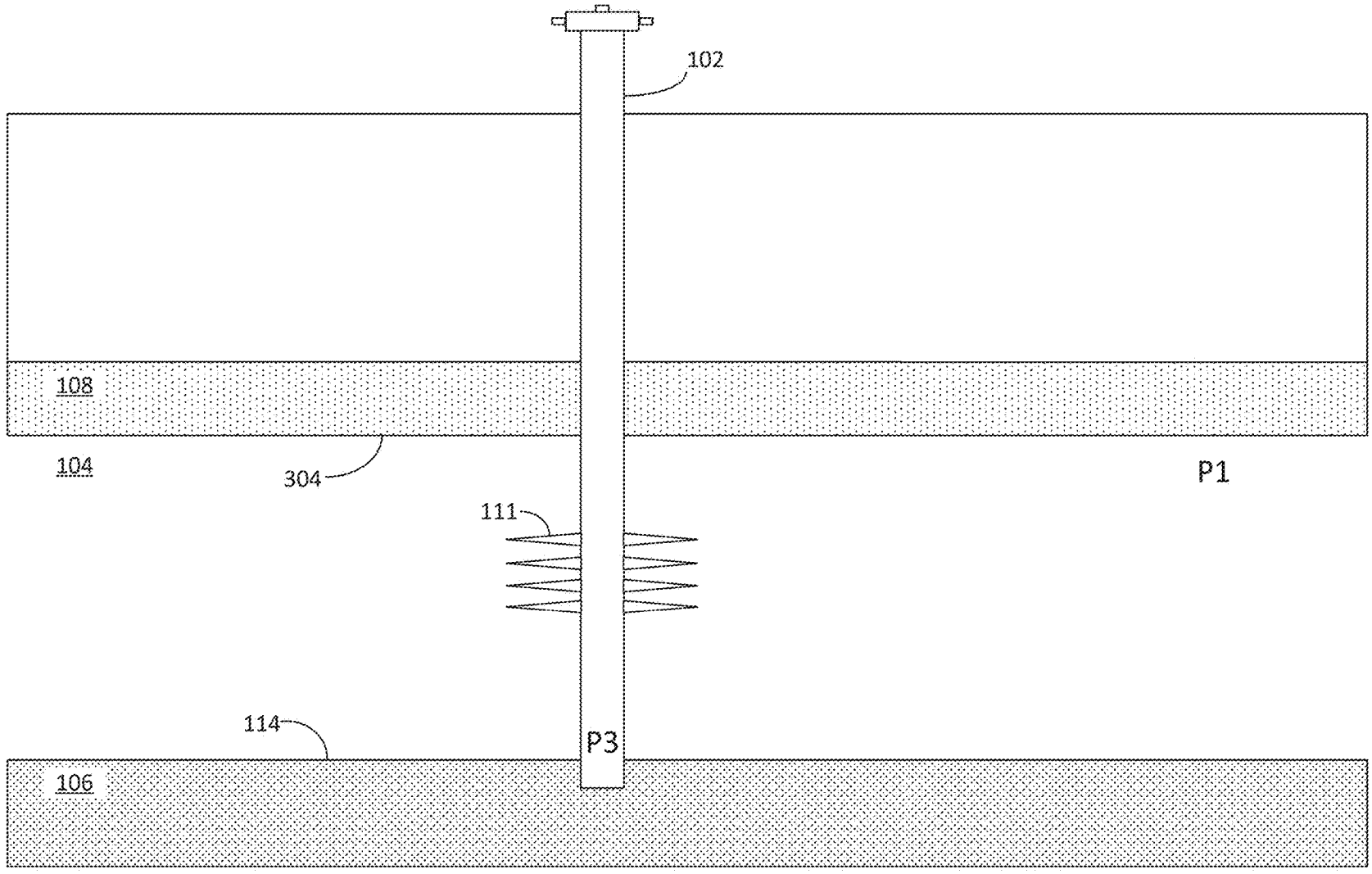
FIG. 1 illustrates a bottom-water drive producing formation.

Poor recovery of the estimated OOIP from vertical wells has been extensively studied. FIG. 1 illustrates a bottom water drive system wherein producing well 102 is configured within a producing reservoir 104 that is disposed between an aquifer 106 and a gas-bearing formation (i.e., a "gas cap") 108. The producing well is configured with perforations 111, which are shown toward the center of the producing zone 104, which is typical in bottom water drive wells. The design of the bottom water drive is for the water level 114 (i.e., the oil water interface, also referred to as the oil water contact (OWC)) to rise uniformly across the producing reservoir to the point of the perforations in the production casing. On initial production the water oil interface 114 is in equilibrium in pressure with the gas cap 108 (corrected for the hydraulic pressure because of the increased elevation, which may be a few psi, depending on the depth of the reservoir). If the water level increases uniformly to the production point, then the recovery from the reservoir is limited to about 50% of the estimated OOIP for a limited area, which is typically about 10 acres.

As oil is produced from the reservoir, the gas-oil interface 304 (also referred to as the gas oil contact (GOC)) drops, which causes the pressure within the gas cap 108 to drop. As soon as the gas cap pressure drops a few psi, any horizontal hydraulic thrust provided by the gas cap from P1 to P3 is eliminated and bottom water drive pressure becomes dominant. The loss of the horizontal hydraulic thrust from P1 to P3 limits the transfer of oil to the production point, i.e., the perforations. As the bottom water drive dominates, coning can begin to exist.

Figure 2:
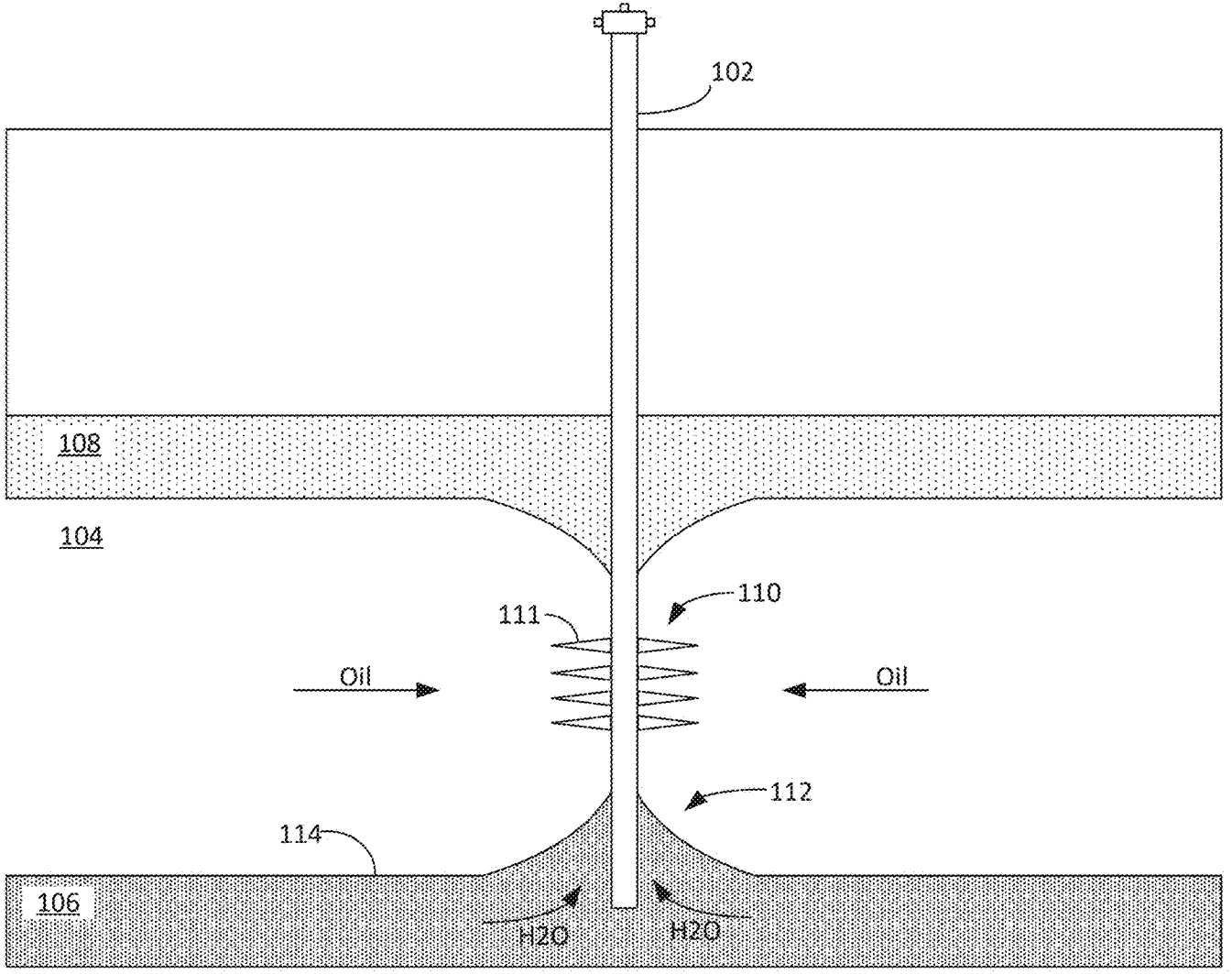
FIG. 2 illustrates coning in a bottom-water drive producing formation.

Studies of production problems in bottom water drive wells have been devoted to studies of coning of water to the production point, which causes the well to "water out." This problem is illustrated in FIG. 2 as a coning area 112 where the oil water contact (OWC) 114 approaches the producing interval 110. If the rate of oil production exceeds a critical rate at which a cone can be formed, which will eventually lead to water being produced with the oil. The encroachment of water into the producing interval because of coning seriously affects the well's productivity. There are costs associated with the need to lift, dispose of, or re-inject produced water and the water can be corrosive to the equipment it contacts. In many cases, wells using a bottom water drive mechanism are abandoned because of water production, with some fields producing as little as a 5% oil cut with a 95% water cut.

Techniques exist in the prior art for limiting or abating water coning. Many such methods involve partial perforation (perforating only a limited portion of the pay zone), maintaining a low production rate, using a perforation standoff distance, implementing water injection strategies, and gravel packing; all aimed at minimizing the pressure drawdown near the wellbore and preventing the unwanted fluid (like water or gas) from forming a cone shape and entering the well prematurely. Also, chemical treatment fluid methods for addressing coning are known in the art. For example, U.S. Patent Publication 2013/0312967 describes a method comprising: i) injecting a treatment fluid into the subsoil, having an intermediate density between that of the hydrocarbon fluid and that of the water of the aquifer or the cap gas, said treatment fluid being insoluble in said hydrocarbon fluid, said water and/or said cap gas; ii) waiting for the treatment fluid to settle by gravity at the hydrocarbon fluid/water or hydrocarbon fluid/gas interface; iii) in situ activating said treatment fluid and forming a substantially horizontal permeability barrier with respect to the water of the aquifer or the cap gas.

The inventor has realized that the problem of coning is a problem that arises as a result of a more fundamental problem, which is the loss of the horizontal hydraulic thrust described above with respect to FIG. 1. The inventor has discovered that the prior art has failed to address the effect of horizontal thrust in the reservoir and the pressure differentials that contribute to horizontal thrust. Referring again to FIG. 1, when the pressure at the top of the oil producing zone (P1) is reduced below the pressure required to lift the reservoir, water drive from the aquifer becomes the dominant driving force. This phenomenon can occur, for instance, when the gas drive pressure decreases from 3500 psi to just a few psi less for a 9500 ft. lift. At this point, horizontal hydraulic thrust is lost and coning can begin to be a problem depending on the production rate.

Aspects of this disclosure relate to methods and associated facilities for enhanced oil recovery (EOR) for addressing coning and loss of horizontal thrust in bottom water drive wells. The disclosed methods essentially eliminate the bottom water drive and replace it with top gas drive. The disclosed methods involve using an injection well to inject an external gas supply into the gas cap in the vicinity of a producing well to provide a constant top drive for oil production and to maintain the pressure to lift the well from the top throughout the life of the well. This serves to maintain a constant oil water interface (i.e., OWC) level throughout the life of the well. This limits bottom water coning and maintains a maximum horizontal thrust to transfer oil to the production perforations. In some embodiments the external gas supply may comprise natural gas, though other gases may be used. Natural gas may be preferred as the external gas so that the gasses existing in the gas cap may later be recovered and used. The disclosed methods may substantially expand the area of recovery. The production rate is limited to the transfer rate of oil to the production point to eliminate coning. Aspects of the methods described herein were motivated by a geological conclusion that water feed to the top of the oil reservoir is present on a major sand of a lease in Victoria County, Texas (the 6950 sand). To recover reserves, the location of wells operated or coned should be known, as the injection well should be located an optimum distance from such coned wells based on geological surveys.

Figure 3:
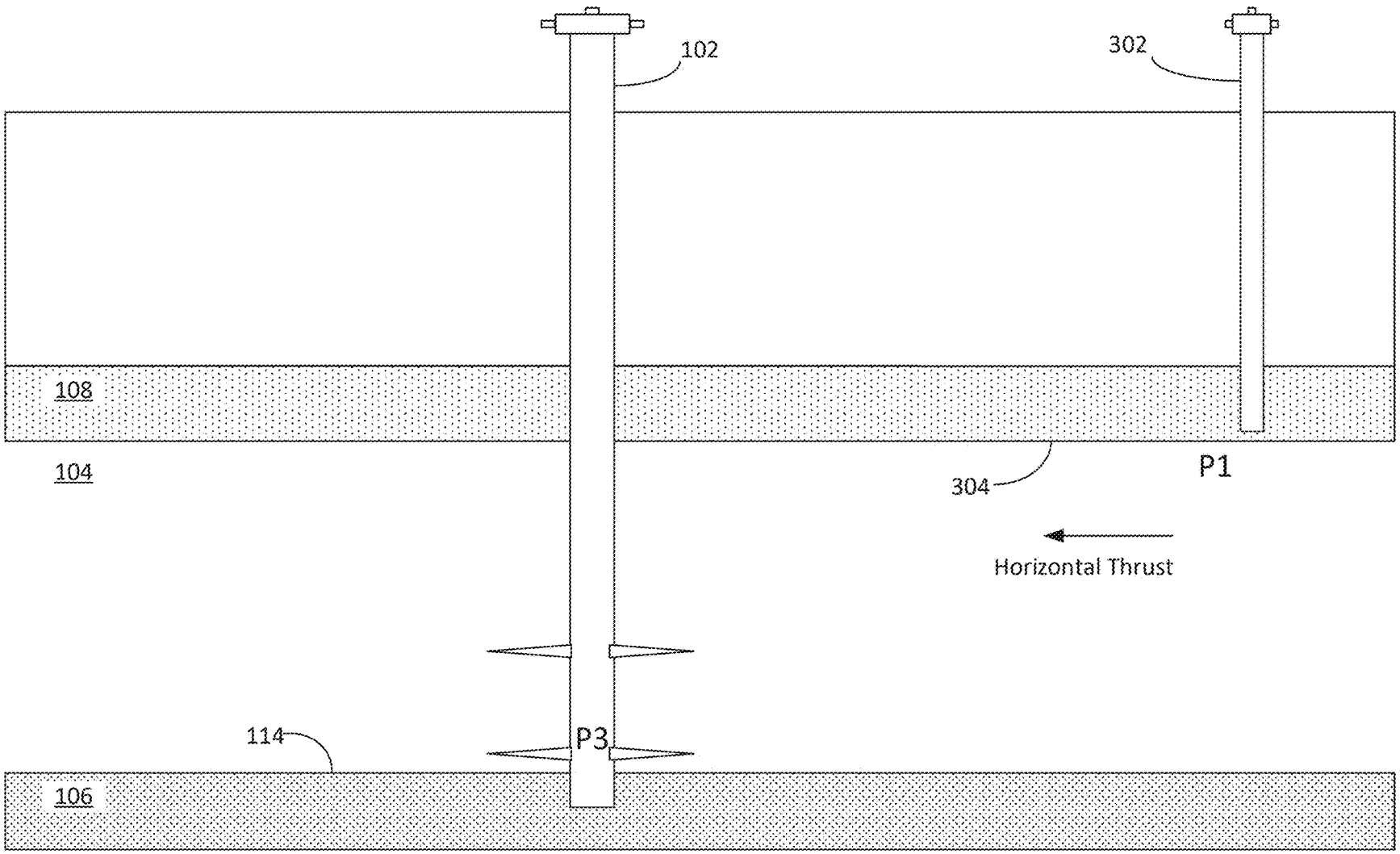
FIG. 3 illustrates a system having a gas injection well configured to deliver an external gas to the gas-oil interface of a formation.

FIG. 3 schematically illustrates an embodiment of the disclosed EOR method. A gas injection well 302 is used to inject the external gas into the gas cap 108 near the gas oil contact (GOC) 304. Notice that the gas injection well terminates above the GOC in the illustrated embodiment. The injected external gas maintains or increases the pressure P1. The injection well may be located generally any distance from the production well so long as there is hydrodynamic communication between the two wells. For example, the injection well 302 may be located about 40 to about 150 feet from the production well. According to some embodiments the gas injection well may be located within 60 feet of the production well. The injection well should be located away from any coned well in the field. Should an adjacent well in the reservoir have water at the top due to channeling, the water will be limited to that well.

The production rate should be limited to correspond to the rate of migration of oil to the production point. Should there be water feed to the top of the oil reservoir, maintaining the top pressure via the gas injection limits further migration to the top of the reservoir. The volume of existing cones in the field should be substantially less than the volume of oil removed to produce the cones. The top pressure provided by the gas injection may force coned water back into the aquifer. The volume of the cone(s) would not be expected to materially affect the OWC level.

FIGS. 4A and 4B illustrate aspects of a production well 400 and an injection well 450, respectively, according to embodiments of the disclosure. The OWC 114 and the GOC 304 are illustrated in FIGS. 4A and 4B, respectively, for reference. The production well extends through the producing formation and into the aquifer. In some embodiments the production well may extend about 40 inches into the aquifer, for example. The injection well terminates within the gas cap. Both configurations include components that are familiar to people of skill in the art, such as service valves 402, valves 404, valves 406 below the tubing hanger 408, and casings 410. In some embodiments the casing of the injection well may comprise 2⅞ inch casing, though other sizes may be used. There may be an advantage of using a larger casing and production tube in the production well to reduce any tendency to cone for a fixed production rate due to the effect of degassing in the production tube. The production well 400 is configured with a production tubing 418 and the injection well is configured with an injection tubing 426. The production well 400 comprises a shoe 412, whereas the injection well is cut off below the packer 416. The injection well 450 is configured with a gas check valve 428 for controlling any outflow in case of a leak of external gas 430 provided by surface gas facilities discussed below.

The casing 410 of the production well is perforated by perforations 414. A specific configuration of an embodiment of the perforations are described in more detail below with reference to FIG. 6. But here it is briefly mentioned that the perforations 414 are typically located within the bottom third of the producing reservoir. The perforation locations may be identified based on core samples and/or electronic logging data. The illustrated configuration comprises upper perforations 604 and lower perforations 602.

Both the production well 400 and the injection well 450 may be configured with packers 416 and 417, respectively. The injection well packer 417 may be any packer familiar to those of skill in the art. The packer 416 of the production well may be affixed to the production tubing 418 via tabs 415. This configuration allows the packer to move with the production tubing as the production tubing is moved within the casing to block the upper perforations when the reservoir is partially depleted. Some embodiments of the production well may also be configured with a lower perforation blocker 430. In some embodiments, the perforation blocker 430 may comprise a length of tubing 432 of adequate length to block the lower perforated length and of an adequate diameter to provide a close tolerance to the inner diameter of the casing 410. The cylinder may be welded to the production tubing 418 via top and bottom struts 434. The struts 434 may be configured with fluid bypasses 436 to allow fluid to flow through the annulus to maintain production with the bottom perforations closed. In other embodiments, the perforation blocker may be made of a suitable polymer configured to attach to the production tube. Again, the perforation blocker comprises fluid bypasses to allow for fluid flow.

In some embodiments the tubing hanger 408 of the production well may be configured so that the production tubing may be dropped predefined distances to reposition the packer 416 and/or the lower perforation blocker 430 within the casing 410. For example, the tubing hanger may be configured to maintain the production tubing in a first position wherein both the top and the bottom perforations are open, a second position wherein the top perforations are blocked and the bottom perforations are open, and a third position wherein the bottom perforations are blocked and the top perforations are open. Note that not all embodiments of the production well may comprise the described bottom perforation blocker.

When the well is installed the packer and the lower perforation blocker are positioned on the production tubing in proper locations to allow the selective closing of either the top or the bottom perforations, depending on the length of the production tube. The positioning of the packer and the perforation blocker with respect to the upper and lower perforations, respectively, will account for the lengthening of the production tube under its hanging weight. In an example configuration, the packer 416 may be installed 12 inches above the depth of the upper perforations and the lower perforation blocker may be installed to be positioned immediately above the lower perforations. This embodiment is illustrated in more detail in FIG. 6 below. Assume that the upper perforations have a perforated length of about 18 inches and the lower perforations have a perforated length of about 6 inches. In the illustrated configuration both the upper and the lower perforations are open. The packer 416 may have a length of at least 24 inches long, and the lower perforation blocker 430 may have a length of at least 12 inches long. To selectively close the bottom perforations the original top spool may be substituted with one that is 12 inches longer, thereby moving the lower perforation blocker down to block the lower perforations. To selectively close the top perforations the original top spool may be removed and substituted with one that is 24 inches longer. This closes the top perforations and moves the bottom perforation blocker past the lower perforations, thereby opening the bottom perforations and closing the top ones. Changing the length of the pipe in this way may involve shutting down the well and killing it with brine to lower the fluid level in the well. Then the top valve assembly may be removed and the tubing lifted to change the top spool.

Figure 5:
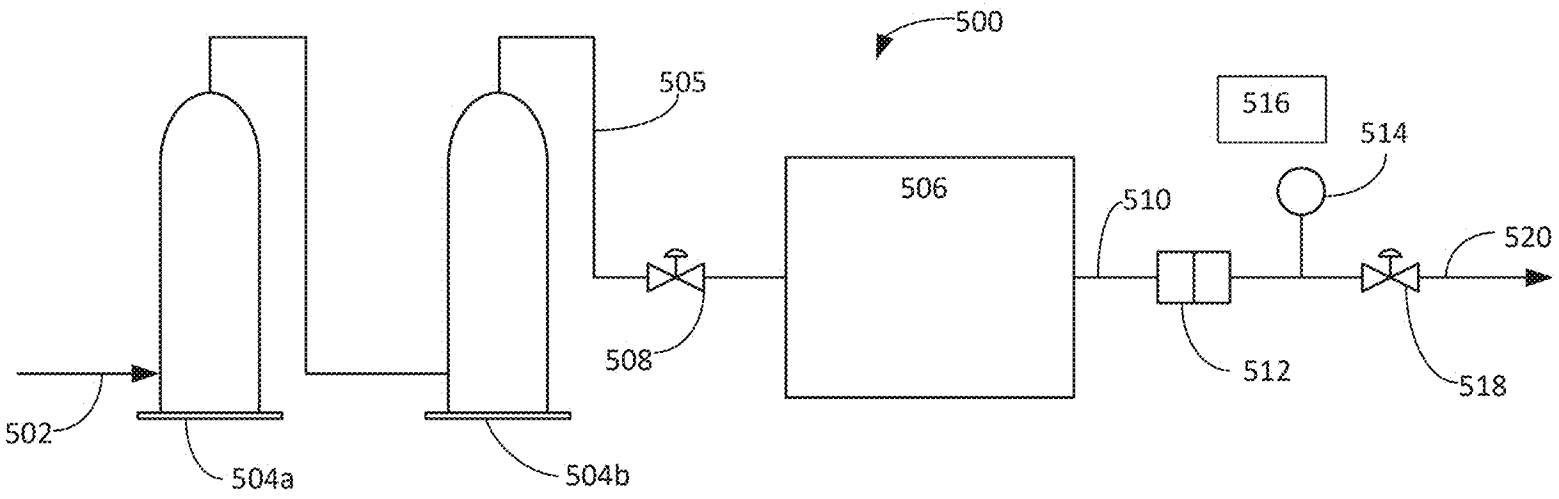
FIG. 5 illustrates gas handling facilities for external gas injection.

FIG. 5 illustrates an embodiment of surface facilities 500 for providing the external gas to the injection well. An external gas feed 502 is provided to one or more gas dehydrators 504*a* and 504*b*. As mentioned above, the external gas 502 may be natural gas, for example. In the illustrated embodiment, the external gas is natural gas. The natural gas may be supplied from a gas-producing well in the oil field or may be piped to the facilities 500 from off-site. The dehydrators 504 a and b, may comprise any dehydration technology known in the art. For example, the dehydrators may be absorption dehydrators based on triethylene glycol (TEG) or other absorption technology. The dehydrated gas 505 may be provided to a compressor 506 via a valve 508, which may be a flow control valve. Compressed gas 510 may be provided to a measuring flow orifice 512. A pressure sensor 514 may be configured to measure the pressure of the gas exiting the flow orifice 512. Flow control metering 516 may be configured to maintain the gas injection rate and or the pressure of the external gas injection. The flow rate is adjusted to maintain the original gas pressure. The facilities 500 may be configured with one or more safety shutdown valves 518. Gas conduit 520 is configured to deliver the external gas to the injection well.

In some embodiments the flow control of the gas injected is set by correlations with the volume of oil removed from the reservoir and the volume of gas injected at gas cap conditions. Generally, the goal is to inject a volume of gas equal to the volume of oil produced from the well. This is to maintain the initial pressure at the GOC. Typically, the volume of oil removed is specific and does not change day by day. For example, the control metering equipment 516 may be configured to control the compressor maintain a flow rate of the external gas to maintain pressure at the top of the gas zone. Initially, the pressure within the gas zone may be measured at the completion of the well. The flow control/metering may be configured to maintain the pressure within the gas cap to at least the initial gas pressure, or greater. The gas oil interface may be identified based on logging data and/or core samples. The gas pressure is the same at the top of the injection point as it is at the top of the gas zone (corrected for the specific gravity, which is 2.4 psi for methane at 3500 psig). The density of the gas in the injection tube is lower, due to the increased temperature at depth within the zone. The change in density may be irrelevant, since the control parameter is the pressure at the gas cap. Generally, deviations from ideal gas law behavior may be dealt with without using a compressibility factor. But embodiments where the control parameter is pressure, such deviations may become irrelevant. For a well producing 20 bbls/day, the gas injection rate of 12.7 mcf/day is calculated to be equivalent to displace 20 bbls of oil with 112 cubic feet. The reported solubility of methane in crude oil at 3500 psig and 200° F. is 850 scf/bbl. However, that stream may contain significant quantities of higher molecular weight LNGs. High methane natural gas may be purchased from pipeline or produced on site. It should be noted that the injected natural gas can be recovered and resold once the oil production is completed or it can be used to produce a second zone in the same well or a new production well.

The gas-oil interface and the oil-water interface can be measured through the injection tube by wireline. The Table 1 below indicates the information that can be realized by this measurement. Specifically, Table 1 shows the calculated amount of oil production for a 6 inch decrease in the gas-oil interface relative to the area of recovery with a constant water-oil interface for a one year period. In other words, as the level of the gas-oil interface drops six inches, Table 1 tabulates the amount of producible oil expected to be contained in that volume. The calculations assume a porosity value of 0.15 even if the measured porosity is higher. It should be noted that some slope of the oil-gas interface from the extremity of the recovery area may be expected. The recovery area may not be limited to 30 acres or the recovery area may not reach 30 acres. The methods described herein are expected to expand the area of recovery.

TABLE 1

Calculated production for a 6-inch drop in gas-oil interface for one year period over a given recovery area.

| Recovery Area (acres) | Diameter (ft) | Total Oil (bbls) | Oil/Day (bbls) |
|---|---|---|---|
| 10 | 750 | 5,900 | 16 |
| 20 | 1,053 | 11,632 | 32 |
| 30 | 1,320 | 18,278 | 51 |

Figure 6:
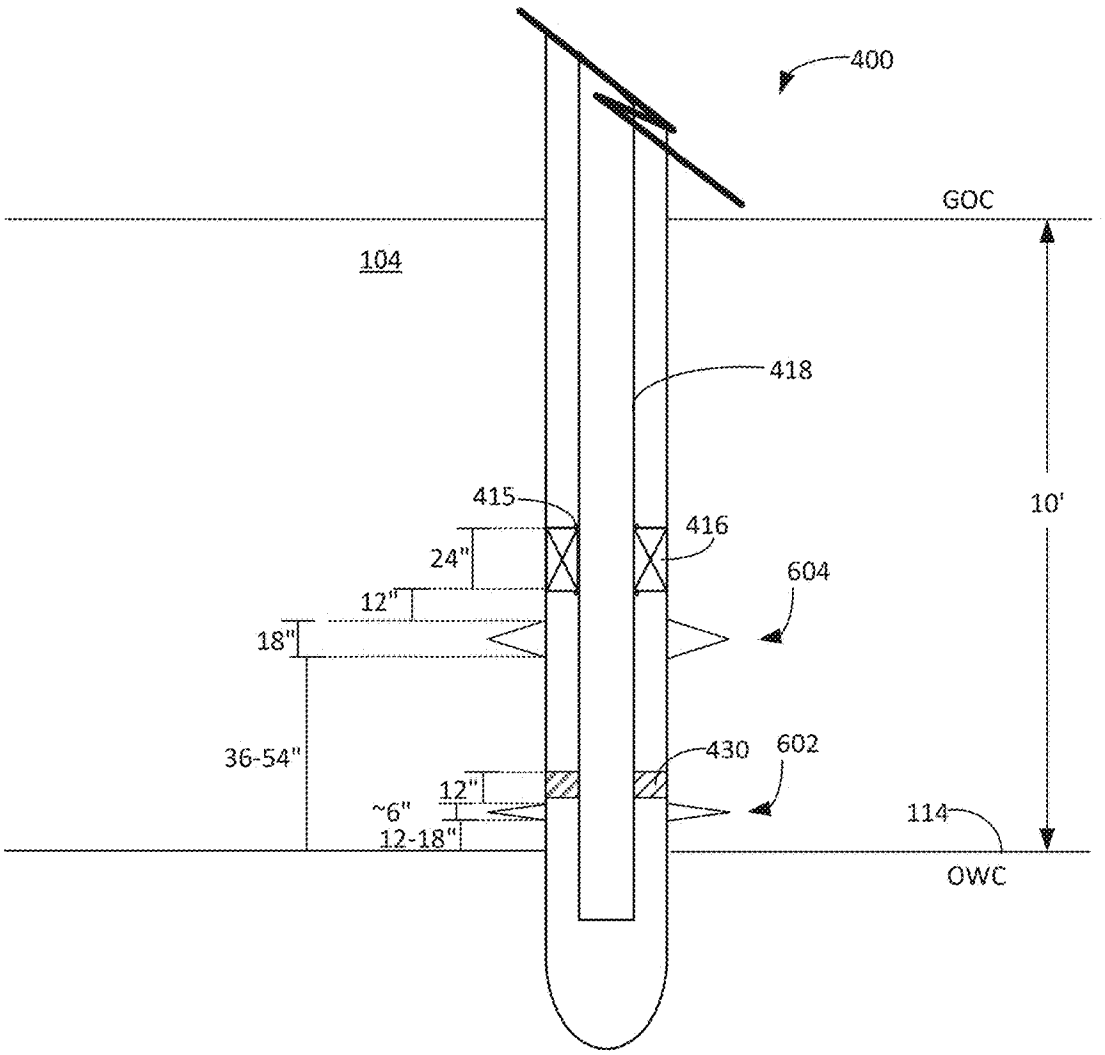
FIG. 6 illustrates a configuration of a producing well in a producing formation.

FIG. 6 illustrates an embodiment of how the production well 400 may be situated in a producing reservoir 104 with respect to the oil water contact (OWC) 114. Note that the drawing is not drawn to scale. In the illustrated embodiment, the producing reservoir 104 is determined to be about 10 feet in width. The casing of the production well is perforated in two locations. The first perforation location is a lower perforation location 602 is located near the OWC. It is important that the location of the lower perforation location 602 be at a level that is substantially within the oil producing reservoir without significant water content as the OWC interface may contain a zone that is a mixture. In the illustrated geometry the lower perforation location 602 is selected at about 12-18 inches above the OWC. In some embodiments the lower perforation level may comprise about 6 inches of perforated length. In the illustrated geometry the upper perforation location 604 is located about 36-54 inches above the OWC and may comprise about 18 inches of perforated length. A person of skill in the art will appreciate the dimensions illustrated here are only exemplary and may be adjusted based on various geological logs. Note that the perforations of the production wells according to the disclosed methods are typically located in the bottom third of the producing reservoir. This is different from the location of perforations for a typical bottom water drive system, wherein the perforations are typically located in the middle of the reservoir. In the illustrated embodiment, the packer 416 is at least 24 inches in length and the bottom perforation blocker is at least 12 inches in length. Note that some embodiments may not include a bottom perforation blocker.

As described above, the illustrated geometry provides for the closure of the upper perforations and/or the closure of the lower perforations by repositioning the packer 416 or the lower perforation blocker 430, respectively, by performing the described shutdown method and replacing the top spool with an appropriate length. To selectively close the bottom perforations the original top spool may be substituted with one that is 12 inches longer, thereby moving the lower perforation blocker 430 down to block the lower perforations 602. To selectively close the top perforations the original top spool may be removed and substituted with one that is 24 inches longer. This closes the top perforations 604 and moves the bottom perforation blocker 430 past the lower perforations, thereby opening the bottom perforations and closing the top ones. In such embodiments, both the lower and upper perforations may be open early in production and the upper perforations may be closed later in production.

Note that the illustrated embodiments show the production well and the injection well as being configured in separate casings. Other embodiments may be configured so that both the production and injection wells are configured within a single casing. This would involve perforating the casing within the gas cap to allow injection of the external gas into the gas cap.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. Thus, the present invention is intended to cover alternatives, modifications, and equivalents that may fall within the spirit and scope of the present invention as defined by the claims.

What is claimed is:

1. A method of recovering oil from a producing formation in the earth, wherein the producing formation is abutted on top by a gas cap and on bottom by an aquifer, the method comprising:

providing a production well extending through the producing formation, providing a gas injection well extending into the gas cap, injecting an external gas into the gas cap via the gas injection well at a controlled rate correlated to oil production such that (i) an injected gas volume at gas-cap conditions replaces the volume of produced oil and (ii) a gas-cap pressure is maintained within a predetermined threshold of an initial gas-cap pressure measured upon completion of the gas injection well, thereby providing sustained top-gas drive and maintaining horizontal hydraulic thrust across the producing formation, and producing the oil via the production well at a production rate limited to a reservoir oil-transfer rate to perforations of the production well so as to maintain a stable oil-water interface and prevent bottom-water coning.

2. The method of claim 1, wherein the external gas comprises natural gas.

3. The method of claim 1, wherein the gas injection well is located about 40 to about 150 feet from the production well.

4. The method of claim 1, wherein the gas injection well terminates above an interface between the gas cap and the producing formation.

5. The method of claim 1, wherein the production well comprises:

a casing, a production tubing configured within the casing, a packer configured within an annulus between the casing and the production tubing, and perforations in the casing providing fluid communication between the producing formation and the annulus.

6. The method of claim 5, wherein the perforations are configured within a bottom third of the producing formation.

7. The method of claim 5, wherein the perforations comprise upper perforations and lower perforations configured below the upper perforations.

8. The method of claim 7, wherein the packer is affixed to the production tubing and wherein the production tubing is configurable in a first position wherein the packer does not block the upper perforations and in a second position wherein the packer blocks the upper perforations.

9. The method of claim 8, wherein producing oil comprises:

producing oil for a first duration with the tubing in the first position, switching the tubing from the first position to the second position, and producing oil for a second duration with the tubing in the second position.

10. The method of claim 7, wherein the lower perforations are located about 12 to about 18 inches above an oil-water interface between the producing formation and the aquifer.

11. The method of claim 1, wherein injecting the external gas comprises injecting an amount of external gas adequate to provide lift of oil within the producing formation.

12. The method of claim 1, wherein producing the oil comprises producing the oil at a rate that eliminates bottom-water coning.

13. The method of claim 1, wherein the injected gas volume is determined by:

measuring an initial gas-cap pressure when the gas injection well is completed;

monitoring a volume of oil produced from the producing formation over a production interval; and injecting an amount of external gas into the gas cap, at gas-cap conditions, calculated to equal the volume of oil produced during the production interval so as to maintain the gas-cap pressure within a predetermined threshold of the initial gas-cap pressure.

14. The method of claim 1, wherein maintaining the gas-cap pressure comprises:

measuring a gas-cap pressure when the gas injection well is completed to establish an initial gas-cap pressure;

monitoring gas-cap pressure during oil production; and controlling injection of the external gas into the gas cap such that the monitored gas-cap pressure is maintained within a predetermined threshold of the initial gas-cap pressure throughout production.

15. The method of claim 1, wherein producing the oil at the production rate limited to the reservoir oil-transfer rate comprises:

determining a rate of migration of oil within the producing formation to the production perforations based on reservoir characteristics; and controlling a production rate of the production well to not exceed the determined oil-migration rate so as to maintain a stable oil-water interface within the producing formation and inhibit upward movement of water from the aquifer toward the production perforations.

16. The method of claim 1, wherein producing the oil at the production rate limited to the reservoir oil-transfer rate comprises:

monitoring a position of an oil-water contact within the producing formation over time; and adjusting the production rate of the production well in response to the monitored oil-water contact position such that the oil-water contact remains stationary relative to the production perforations, thereby inhibiting bottom-water coning.

* * * * *